United States Patent [19]

Buck

[11] 4,192,603

[45] Mar. 11, 1980

[54] REPLENISHABLE PHOTOCONDUCTOR SYSTEM

[75] Inventor: Kenneth J. Buck, Ontario, N.Y.

[73] Assignee: Xerox Corporation, Stamford, Conn.

[21] Appl. No.: 946,006

[22] Filed: Sep. 27, 1978

[51] Int. Cl.[2] ..... G03G 15/00

[52] U.S. Cl. ..... 355/3 BE; 355/16

[58] Field of Search ..... 355/3 R, 3 DR, 3 BE, 355/16

[56] References Cited

U.S. PATENT DOCUMENTS

| | | | |
|---|---|---|---|
| 3,533,692 | 10/1970 | Blanchette et al. | 355/16 |
| 3,903,795 | 9/1975 | Suzuki | 355/3 DR X |
| 3,930,852 | 1/1976 | Tanaka et al. | 355/16 X |
| 4,062,631 | 12/1977 | Ichikawa et al. | 355/16 X |
| 4,088,403 | 5/1978 | Kingsley | 355/3 BE X |
| 4,110,758 | 8/1978 | Nelson et al. | 226/113 X |

*Primary Examiner*—Fred L. Braun

*Attorney, Agent, or Firm*—J.J. Ralabate; C.A. Green; H. Fleischer

[57] ABSTRACT

A photoconductor belt assembly employs a sub-belt having a photoconductive belt secured releasably thereto. The photoconductive belt is advanced from storage and positioned in contact with the sub-belt so as to be readily attached thereto. As the sub-belt advances, the photoconductive belt is positioned thereon in a substantially wrinkle-free condition.

8 Claims, 2 Drawing Figures

REPLENISHABLE PHOTOCONDUCTOR SYSTEM

BACKGROUND OF THE INVENTION

This invention relates generally to a photoconductor belt assembly employed in an electrophotographic printing machine, and more particularly concerns an improved apparatus for replacing used photoconductive belts in the printing machine.

In an electrophotographic printing machine, a photoconductive belt is charged to a substantially uniform potential so as to sensitize the surface thereon. Thereafter, the charged portion of the photoconductive belt is exposed to a light image of an original document being reproduced. Exposure of the charged photoconductive belt selectively discharges the charge thereon in the irradiated areas. This records an electrostatic latent image on the photoconductive belt corresponding to the informational areas contained within the original document being reproduced. After the electrostatic latent image is recorded on the photoconductive belt, the latent image is developed by bringing a developer mix into contact therewith. The developer mix comprises toner particles adhering triboelectrically to carrier granules. These toner particles are attracted from the carrier granules to the latent image forming a toner powder image thereon. The toner powder image is then transferred to a copy sheet. Finally, the copy sheet is heated to permanently affix the toner particles thereto in image configuration. This general approach was originally disclosed by Carlson in U.S. Pat. No. 2,297,691, and has been further amplified and described by many related patents in the art.

Generally, an electrophotographic printing machine utilizes either a photoconductive drum or belt. Various materials have been proposed for photoconductive belts or drums employed in electrophotographic printing machines. One well known material is made from a selenium alloy which is capable of producing a substantially large number of copies before replacement is required. Another material may be of an organic type. However, organic photoconductor materials also have a limited life and require replacement.

A new technique for replacing photoconductive belts utilizes a sub-belt that moves about an endless path in the printing machine. A photoconductive belt is secured releasably to the sub-belt and stripped therefrom when replacement is required. If the path that the sub-belt traverses is constructed as a perfect cylinder, there is little difficulty in accurately mating the photoconductive belt to the sub-belt. However, when the path of the sub-belt takes the shape of a cone, the longitudinal elements of the sub-belt are no longer a straight line but rather arcs of a circle with its center at the apex of the cone. This prevents the placement of a rectangular photoconductive belt sections on the surface of the sub-belt. The path of the photoconductive belt must correspond identically to the conical path of the sub-belt. To achieve the foregoing, the photoconductive belt must be provided with sufficient degrees of freedom to change its angle of approach and position relative to the roller driving the sub-belt. Only under these latter circumstances will the photoconductive belt be secured to the sub-belt in a wrinkle-free state.

Accordingly, it is a primary object of the present invention to improve the apparatus employed in replacing photoconductive belts in an electrophotographic printing machine.

PRIOR ART STATEMENT

Various types of devices have hereinbefore been developed to improve replenishment of photoconductive belts. The following prior art appears to be relevant:

| | | |
|---|---|---|
| Berlier et al. | 3,588,242 | June 28, 1971 |
| Swanke | 3,619,050 | November 9, 1971 |
| Schrempp et al. | 3,877,806 | April 15, 1975 |
| Schrempp et al. | 3,984,241 | October 5, 1976 |

The pertinent portions of the foregoing prior art may be briefly summarized as follows:

Berlier et al. describes a printing machine employing a copy drum utilizing an organic photoconductor stored as a flexible strip on a supply reel located within the interior of the drum. The flexible photoreceptor is advanced from the supply reel and fed about the external periphery of the drum and returned to a take-up reel located inside the drum. A metering apparatus, located within the drum, actuates a switch to terminate the advancing operation when a pre-determined length of photoreceptor material has been moved from the supply reel to the take-up reel.

Swanke discloses an electrophotographic printing machine using an electrophotosensitive web which is replacable. The electrophotosensitive web is stored in a cartridge located near the web path. The leading edge of the web is received by a tow bar. The web is advanced from the cartridge and threaded through the machine. The leading and trailing edges are spliced to form a continuous belt. The belt is wrapped around rollers to form an endless belt path. Replacement of the belt occurs by separating the web and feeding it back into the cartridge for removal from the printing machine. A new cartridge is then inserted into the printing machine and the process repeated.

The Schrempp et al. patents describe a photocopying machine employing a photoconductor assembly having a photoconductor belt and a cartridge for storing a new supply of photoconductive material. The photoconductor belt and cartridge are located between laterally spaced drive belts. The belts are entrained about spaced rollers. The photoconductive belt extends from a supply spool mounted interiorly of the cartridge about the rollers and back to the take-up spool also mounted interiorly of the cartridge. The photoconductor belt and cartridge move as one unit about the photoconductor belt path.

It is believed that the scope of the present invention, as defined by the appended claims, is patentably distinguishable over the foregoing prior art taken either singly or in combination with one another.

SUMMARY OF THE INVENTION

Briefly stated, and in accordance with the present invention, there is provided a belt assembly having a replaceable photoconductor.

Pursuant to the features of the invention, the assembly incudes a sub-belt having a photoconductive belt secured releasably thereto. Means are provided for storing the photoconductive belt. The storing means is arranged to position the photoconductive belt in contact with the sub-belt. In this manner, the photoconductive belt is attached to the sub-belt.

BRIEF DESCRIPTION OF THE DRAWINGS

Other objects and advantages of the present invention will become apparent upon reading the following detailed description and upon reference to the drawings, in which.

While the present invention will hereinafter be described in connection with the preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
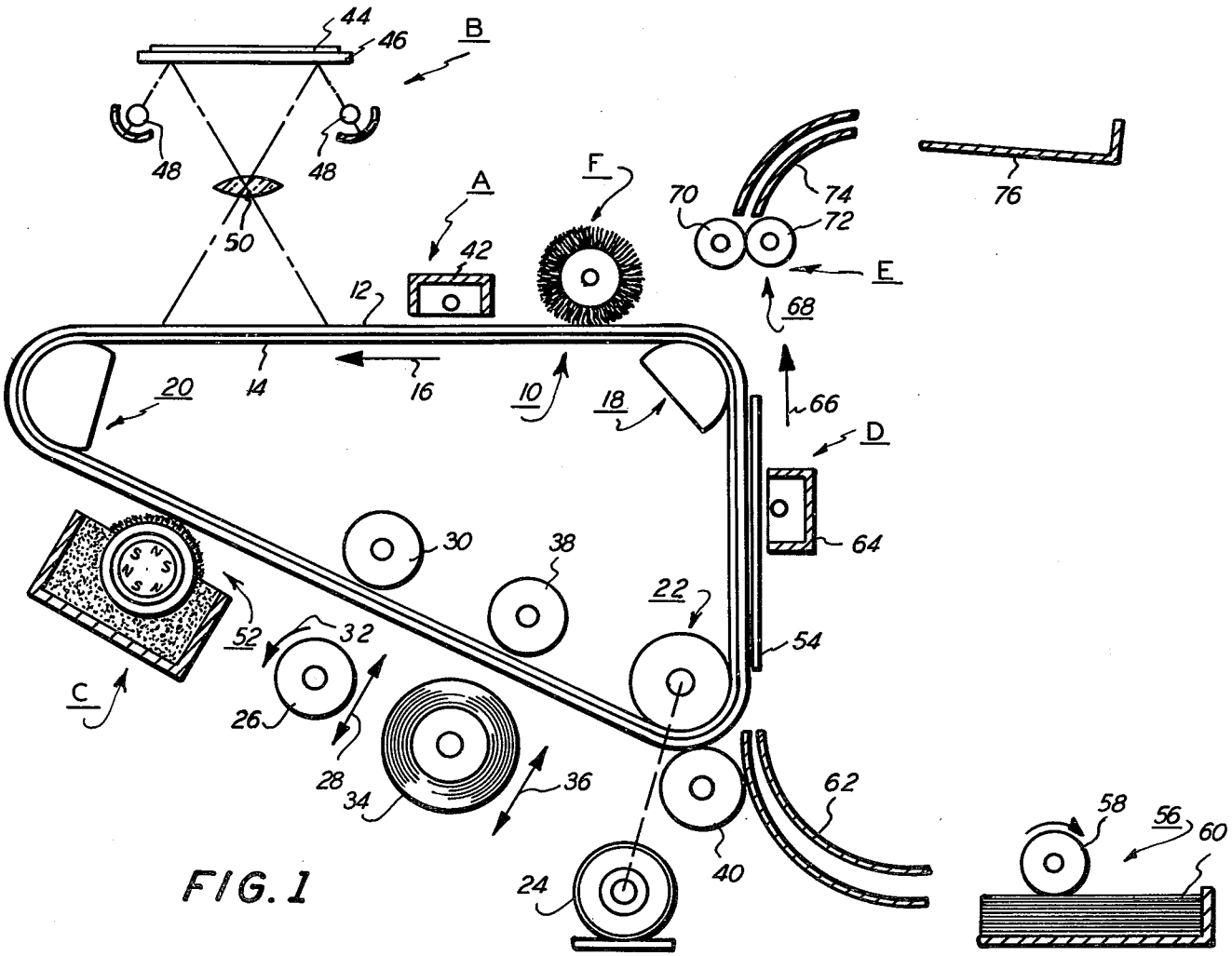
FIG. 1 is a schematic elevational view depicting an electrophotographic printing machine incorporating the features of the present invention therein.

For a general understanding of the illustrative electrophotographic printing machine incorporating the features of the present invention therein, reference is had to the drawings. In the drawings, like reference numerals have been used throughout to designate identical elements. FIG. 1 schematically depicts the various components of the electrophotographic printing machine employing the photoconductive belt replacement mechanism of the present invention therein. Although the belt replacement mechanism is particularly well adapted for use in an electrophotographic printing machine, it will become evident from the following discussion that it is equally well suited for use in a wide variety of devices and is not necessarily limited in this application to the particular embodiment shown herein.

Inasmuch as the art of electrophotographic printing is well known, the various processing stations employed in the FIG. 1 printing machine will be shown hereinafter schematically, and their operation described briefly with reference thereto.

Turning now to FIG. 1, the electrophotographic printing machine employs a photoconductor belt assembly 10 comprising a photoconductive belt 12 secured releasably to a transparent sub-belt 14. Preferably photoconductive belt 12 is an organic photoconductor while sub-belt 14 is made from a transparent material such as Mylar. Photoconductive belt 12 is secured releasably to sub-belt 14 and moves in unison therewith in the direction of arrow 16. In this way, photoconductive belt 12 moves sequentially through the various processing stations disposed about the path of movement thereof. Sub-belt 14 is entrained about steering post 18, tension post 20, and drive roller 22. Tension post 20 is mounted resiliently on a pair of springs and arranged to pivot about an axis substantially normal to the longitudinal axis thereof. The pivot axis is substantially normal to the plane defined by the approaching belt assembly 10. Belt end guides or flanges are positioned on both sides thereof and define a passageway through which belt assembly 10 passes. Steering post 18 is mounted pivotably and has a moment applied thereon by belt assembly 10 tilting thereof in a direction to reduce the approach angle of belt assembly 10 to drive roller 22, i.e. the belt velocity vector relative to the normal to the drive roller axis of rotation. This restores belt assembly 10 to the pre-determined path of movement minimizing lateral deflection. Post 18 is adapted to pivot about an axis substantially normal to the longitudinal axis thereof. The pivot axis is substantially perpendicular to the plane defined by the approaching belt assembly 10. Drive roller 22 is in engagement with sub-belt 14 and advances belt assembly 10 in the direction of arrow 16. Roller 22 is rotated by motor 24 coupled thereto by suitable means, such as a belt. A blower system is connected to steering post 18 and tension post 20. Both steering post 18 and tension post 20 have small holes in the circumferential surface thereof coupled to an interior chamber. The blower system furnishes pressurized fluid, i.e. a compressible gas such as air, into the interior chamber. The fluid exits from the interior chamber through the apertures to form a fluid film between sub-belt 14 and the respective posts, i.e. steering post 18 and tension post 20. In this manner, the fluid film at least partially supports belt assembly 10 as it passes over the respective post diminishing friction therebetween. A common blower system is employed for both steering post 18 and tension post 20.

Photoconductive belt 12 is designed to be periodically removed from sub-belt 14 and replaced with a new photoconductive belt. This prevents copy quality degradation in the printing machine. The printing machine employs logic circuitry which includes a counter. The counter registers the number of copies reproduced. After a pre-determined number of copies have been reproduced, e.g. 40,000, the replenishment mechanism is actuated. Initially, take-up spool 26 is moved by a solenoid mechanism in the direction of arrow 28 from its initial position spaced from photoconductive belt 12 into contact therewith. At this time, the trail edge of photoconductive belt 12 is positioned over back-up roller 30. Take-up up spool 26 has a double sided adhesive strip extending along the longitudinal axis thereof on the circumferential surface. This adhesive strip is pressed against the trail edge of photoconductive belt 12. Thereafter, spool 26 is returned to its initial position stripping the trailing marginal portion of photoconductive belt 12 from sub-belt 14. Thereafter, spool 26 rotates in the direction of arrow 32 and belt 14 moves in a direction opposed to that of arrow 16 to strip photoconductive belt 12 from sub-belt 14. After the used photoconductive belt 12 has been separated from sub-belt 14, supply spool 34, having a new photoconductive belt thereon, moves from a remote position, in the direction of arrow 34, to press the leading edge of the new photoconductive belt into contact with sub-belt 14 and sub-belt 14 advances in the direction of arrow 16. The leading edge of the new photoconductive belt has a double sided adhesive tape secured thereon. In this way, the leading edge is tacked to sub-belt 12 by pressing supply spool 34 against the sub-belt 14 in the region of back-up roller 38. Next, supply spool 34 returns to its initial position. Thereafter, a clutch couples an indexing motor to supply spool 34 and supply spool 34 rotates so as to at least partially unroll the new photoconductive belt on spool 34. This provides both angular and lateral freedom to the new photoconductive belt. A solenoid arrangement is employed to move supply spool 34 in the direction of arrow 36. The machine logic actuates the clutch and indexing motor to partially unwind the photoconductive belt stored on supply spool 34 after the leading edge thereof has been tacked to sub-belt 12 and spool 34 has returned to its initial position. In this way, both lateral and angular freedom are provided to the unwinding new photoconductive belt being secured to sub-belt 14. It should be noted, that once the leading edge is tacked to sub-belt 14, sub-belt 14 advances in the direction of arrow 16 to unwind the new photoconductive belt from supply spool 34. Inasmuch as the new photoconductive belt being secured to sub-belt 14 has both angular and lateral freedom of movement due to being unwound, at least partially, from supply spool 34, it follows the conical path of sub-belt 14 and lies substantially wrinkle-free on the surface thereof. Roller 40, preferably made from a soft urethane material, is positioned opposed from drive roller 22 and defines a nip through which sub-belt 12 and the new photoconductive belt secured thereto advances. Roller 40 acts like a squeegee and applies a uniform drag across photoconductive belt 12. This insures that new photoconductive belt 12 remains in intimate contact with sub-belt 14 and, simultaneously, permits new photoconductive belt 12 to move laterally so as to follow the belt path defined by sub-belt 14 without forming any bubbles or wrinkles between the two surfaces. After the new photoconductive belt 12 is secured releasably to sub-belt 14, the printing machine is ready to resume operation.

With continued reference to FIG. 1, the operation of the electrophotographic printing machine will now be briefly described. Initially, a portion of photoconductive belt 12 passes through charging station A. At charging station A, a corona generating device, indicated generally by the reference numeral 42, charges photoconductive belt 12 to a relatively high, substantially uniform potential. A suitable corona generating device is described in U.S. Pat. No. 2,836,725 issued to Vyverberg in 1958.

Next, the charged portion of photoconductive belt 12 is advanced through exposure station B. At exposure station B, an original document 44 is positioned face-down upon transparent platen 46. Lamps 48 flash light rays onto the original document. The light rays reflected from the original document are transmitted through lens 50 onto the charged portion of photoconductive belt 12. The charged photoconductive belt is selectively discharged by the light image of the original document. This records an electrostatic latent image on photoconductive belt 12 which corresponds to the informational areas contained within original document 44.

Thereafter, photoconductive belt 12 advances the electrostatic latent image recorded thereon to development station C. At development station C, a magnetic brush developer roller 52 moves the developer mix into contact with the electrostatic latent image recorded on photoconductive belt 12. The developer mix comprises carrier granules having toner particles adhering triboelectrically thereto. The magnetic brush developer roller forms a chain-like array of developer mix extending in an outwardly direction therefrom. The developer mix contacts the electrostatic latent image recorded on photoconductive belt 12. The latent image attracts the toner particles from the carrier granules forming a toner powder image on photoconductive belt 12.

The toner powder image deposited on photoconductive belt 12 is then advanced to transfer station D. At transfer station D, a sheet of support material 54 is positioned in contact with the toner powder image formed on belt 12. The sheet of support material is advanced to the transfer station by a sheet feeding apparatus 56. Preferably, sheet feeding apparatus 56 includes a feed roll 58 contacting the uppermost sheet of the stack 60 of sheets of support material. Feed roll 58 rotates so as to advance the uppermost sheet from stack 60 into chute 62. Chute 62 directs the advancing sheet of support material into contact with photoconductive belt 12 in a timed sequence so that the powder image developed thereon contacts the advancing sheet of support material at transfer station D.

Transfer station D includes a corona generating device 64 which applies a spray of ions to the backside of sheet 54. This attracts the toner powder image from photoconductive belt 12 to sheet 54. After transfer, sheet 54 continues to move in the direction of arrow 66 and is separated from belt 12 by a detack corona generating device (not shown) which neutralizes the charge thereon causing sheet 54 to adhere to belt 12. A conveyor system (not shown) advances the sheet from belt 12 to fusing station E.

Fusing station E includes a fuser assembly, indicated generally by the reference numeral 68, which permanently affixes the transferred toner powder image to sheet 54. Preferably, fuser assembly 68 includes a heated fuser roller 70 and a back-up roller 72. Sheet 54 passes between fuser roller 70 and back-up roller 72 with the toner powder image contacting fuser roller 70. In this manner, the toner powder image is permanently affixed to sheet 54. After fusing, chute 74 guides the advancing sheet 54 to catch tray 76 for subsequent removal from the printing machine by the operator.

Invariably, after the sheet of support material is separated from photoconductive belt 12, some residual particles remain adhering to the surface of belt 12. These residual particles are removed from photoconductive belt 12 at cleaning station F. Cleaning station F includes a rotatably mounted fiberous brush in contact with photoconductive belt 12. The particles are cleaned from photoconductive belt 12 by the rotation the brush in contact therewith. Subsequent to cleaning, a discharge lamp (not shown) floods photoconductive belt 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating therein the photoconductive belt replenishment mechanism of the present invention.

Figure 2:
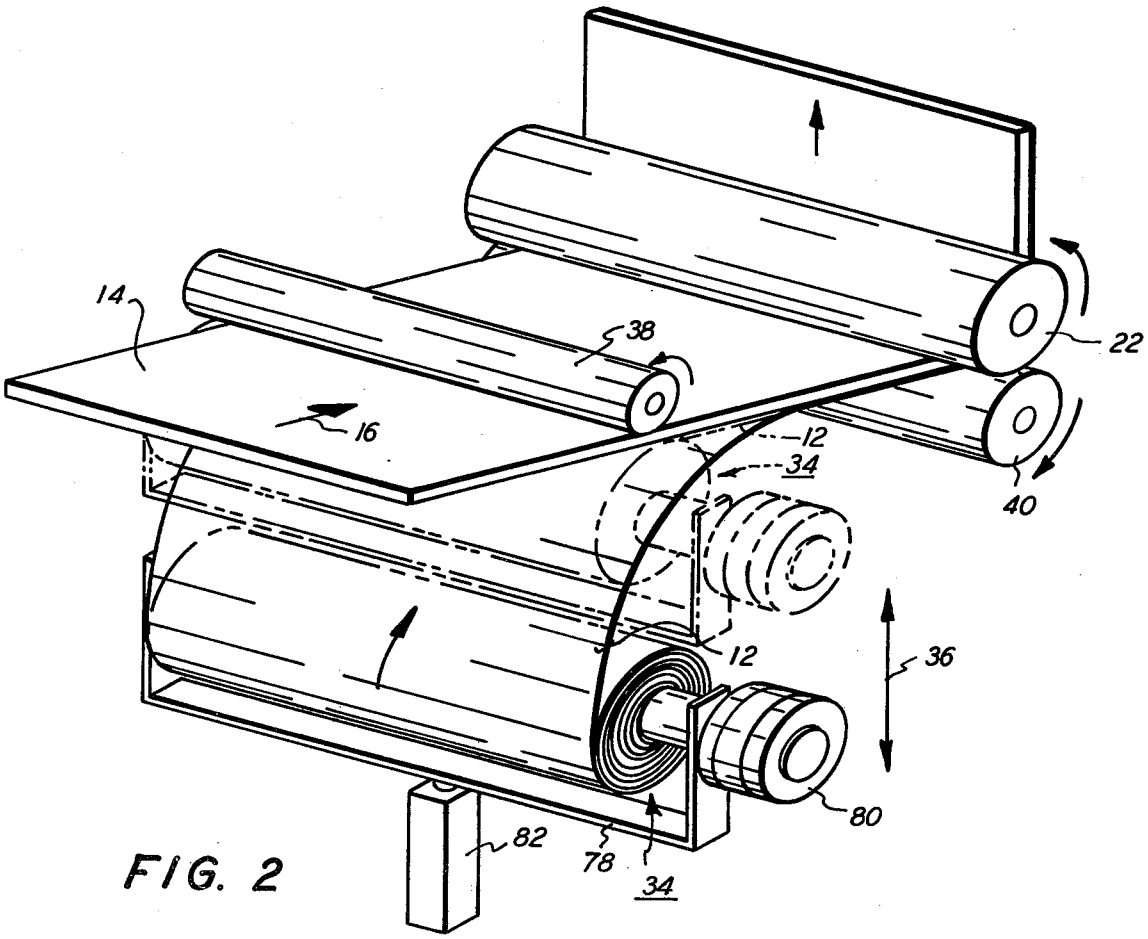
FIG. 2 is a fragmentary perspective view depicting the mechanism for replacing the photoconductive belt employed in the FIG. 1 printing machine.

Referring now to the specific subject matter of the present invention, FIG. 2 depicts the replenishment mechanism in greater detail. As shown therein, supply spool 34 is mounted on a U-shaped yoke 78. Suitable mounting means such as bearings permit spool 34 to rotate relative to yoke 78. An electromechanical clutch couples indexing motor 80 is coupled to the shaft to supply spool 34. When the clutch is energized, indexing motor 80 rotates supply spool 34 to at least partially unwind the new photoconductive belt 12 thereon during the replenishment operation. A solenoid 82 is connected to yoke 78 and, upon actuation, translates supply spool 34 in the direction of arrow 36.

In operation, initially the old photoconductive belt is removed from sub-belt 14. Thereafter, solenoid 82 is actuated translating supply spool 34 from a position remote from sub-belt 14 to a position in contact therewith. In this later position, the leading edge of the supply spool contacts sub-belt 14 directly beneath back-up roll 38. The leading edge of photoconductive belt 12 has a strip of double sided adhesive on the surface thereof engaging belt 14. As supply spool 34 is pressed against sub-belt 14, the leading edge of photoconductive belt 12 is tacked releasably thereto. After photoconductive belt 12 is secured releasably to sub-belt 14, solenoid 82 is de-energized causing supply spool 34 to return to its initial position remote from sub-belt 14 under the influence of gravity. It should be noted that yoke 78 is mounted in a frame having grooves therein for mating with mounting pins on yoke 78. These grooves permit yoke 78 to translate in the direction of arrow 36. Alternatively, springs may be employed to resiliently urge yoke 78 to return to its initial position wherein supply spool 34 is remote from photoconductive belt 14. When supply spool 34 has been returned to its initial position, motor 80 is energized to at least partially unwind the new photoconductive belt 12 from supply spool 34. This permits the new photoconductive belt to move laterally and angularly as it is being unwound from supply spool 34. As supply spool 34 returns to its initial position and the photoconductive belt wound thereabout is at least partially unwound by actuation of motor 80, motor 24 rotates drive roller 22 to advance sub-belt 14 in the direction of arrow 16. This causes photoconductive belt 12 to unwind from supply spool 34.

Sub-belt 14 and the leading edge of photoconductive belt 12 advance in the direction of arrow 16, through a nip defined by drive roller 22 and back-up roller 40. Inasmuch as back-up roller 40 is made from a foam material such as urethane it is highly resilient and acts as a squeegee applying drag to the surface of the photoconductive belt passing therebetween. This insures that there is intimate contact between photoconductive belt 12 and sub-belt 14 while permitting photoconductive belt 12 to move laterally. In this manner, photoconductive belt 12 is secured releasably to sub-belt 14 in a substantially wrinkle-free condition. The lateral and angular freedom provided to belt 12, as it unwinds from supply spool 34, permits belt 12 to follow the path of sub-belt 14 rather than defining a new path which will cause irregularities between the two belts, i.e. wrinkles. Thus, the replenishment mechanism of the present invention insures that a photoconductive belt is attached to a sub-belt permanently secured to the printing machine in a substantially wrinkle-free condition. The foregoing process may be repeated periodically after each photoconductive belt reproduces the requisite number of copies. This insures that copy degradation is minimized and optimum copy quality maintained throughout the life of the electrophotographic printing machine.

In recapitulation, it is evident that the replenishment mechanism of the present invention provides lateral and angular freedom for a new photoconductive belt being secured releasably to a sub-belt mounted permanently in a printing machine. This insures that the new-photoconductive belt is in intimate contact with the sub-belt in a substantially wrinkle-free condition. The foregoing is achieved by moving a supply spool to a position remote from the sub-belt after the leading edge of the photoconductive belt is attached to the sub-belt. Thereafter, the supply spool is at least partially unwound to permit both angular and lateral freedom for the unwinding photoconductive belt.

It is, therefore, evident that there has been provided in accordance with the present invention, an apparatus for replenishing a photoconductive belt in an electrophotographic printing machine such that the new-photoconductive belt is in intimate contact with a sub-belt mounted permanently in the printing machine, and that there are substantially no wrinkles in the new photoconductive belt secured thereto. This apparatus fully satisfies the objects, aims, and advantages hereinbefore set forth. While the invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A belt assembly having a replaceable photoconductive belt, including:

a sub-belt;

means for supporting movably said sub-belt, said suporting means defining a path about which said sub-belt moves in unison with the photoconductive belt secured releasably thereon;

a supply spool holding the photoconductive belt;

means for moving said supply spool from a position wherein the lead edge of the photoconductive belt contacts said sub-belt so as to be secured releasably thereto to a position remote therefrom with the lead edge of the photoconductive belt remaining secured to said sub-belt; and means for partially unwinding the photoconductive belt from said supply spool with said supply spool being in the remote position so that the photoconductive belt moves freely and adheres to said sub-belt in a substantially wrinkle-free condition.

2. An assembly as recited in claim 1, further including a back-up roll positioned to support said sub-belt when said supply spool is in contact therewith.

3. An assembly as recited in claim 2, further including means for applying a substantially uniform drag on the photoconductive belt moving in unison with said sub-belt.

4. An apparatus as recited in claim 3, wherein said support means includes:

a plurality of spaced posts having said sub-belt entrained about the outer peripheries thereof;

a drive roller contacting said sub-belt; and means for rotating said drive roller to move said sub-belt in unison with the photoconductive belt secured releasably thereon.

5. An electrophotographic printing machine of the type having a photoconductive belt assembly moving about a pre-determined path through a plurality of processing stations, wherein the improvement includes:

a sub-belt;

means for supporting movably said sub-belt, said supporting means defining a path about which said sub-belt moves in unison with the photoconductive belt secured releasably thereon;

a supply spool holding the photoconductive belt;

means for moving said supply spool from a position wherein the lead edge of the photoconductive belt contacts said sub-belt so as to be secured releasably thereto to a position remote therefrom with the lead edge of the photoconductive belt remaining secured to said sub-belt; and means for partially unwinding the photoconductive belt from said supply spool with said supply spool being in the remote position so that the photoconductive belt moves freely and adheres to said sub-belt in a substantially wrinkle-free condition.

6. A printing machine as recited in claim 5, further including a back-up roll positioned to support said sub-belt when said supply spool is in contact therewith.

7. A printing machine as recited in claim 6, further including means for applying a substantially uniform drag on the photoconductive belt moving in unison with said sub-belt.

8. A printing machine as recited in claim 7, wherein said supporting means includes:

a plurality of spaced posts having said sub-belt entrained about the outer peripheries thereof;

a drive roller contacting said sub-belt; and means for rotating said drive roller to move said sub-belt in unison with the photoconductive belt secured releasably thereon.

* * * * *